US010845030B1

(12) United States Patent
Tornyai

(10) Patent No.: US 10,845,030 B1
(45) Date of Patent: Nov. 24, 2020

(54) LIGHTING FIXTURE WITH INTERNAL SHUTTER BLADE

(71) Applicant: Electronic Theatre Controls, Inc., Middleton, WI (US)

(72) Inventor: Frank Tornyai, Santa Maria, CA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 16/801,543

(22) Filed: Feb. 26, 2020

(51) Int. Cl.

| | |
|---|---|
| ***F21V 11/02*** | (2006.01) |
| ***F21V 7/04*** | (2006.01) |
| ***F21V 5/00*** | (2018.01) |
| ***F21V 5/04*** | (2006.01) |
| ***F21V 7/00*** | (2006.01) |
| *F21Y 113/13* | (2016.01) |

(Continued)

(52) U.S. Cl.
CPC ..... *F21V 7/04* (2013.01); *F21V 5/007* (2013.01); *F21V 5/008* (2013.01); *F21V 5/045* (2013.01); *F21V 7/0066* (2013.01); *F21Y 2105/18* (2016.08); *F21Y 2113/13* (2016.08); *F21Y 2115/10* (2016.08)

(58) Field of Classification Search
CPC ..... F21Y 2115/10; F21Y 2105/00; F21Y 2105/12; F21Y 2105/14; F21Y 2105/16; F21Y 2105/18; F21V 11/18; F21V 11/185; F21V 14/08; F21V 5/007; F21V 7/04
See application file for complete search history.

(56) References Cited

U.S. PATENT DOCUMENTS

| | | | |
|---|---|---|---|
| 4,179,726 | A | 12/1979 | Aron |
| 5,622,426 | A | 4/1997 | Roman et al. |
| 6,200,002 | B1 | 3/2001 | Marshall et al. |

(Continued)

FOREIGN PATENT DOCUMENTS

| | | | |
|---|---|---|---|
| EP | 1482240 | B1 | 3/2008 |
| EP | 1844262 | B1 | 4/2009 |
| WO | 2015138483 | A2 | 9/2015 |

OTHER PUBLICATIONS

Diaz, "Prototyping illuminations systems with stock optical components" Photonik International 2012 originally published in German in Photonik Mar. 2012 (4 Pages).

(Continued)

*Primary Examiner* — Robert J May
(74) *Attorney, Agent, or Firm* — Michael Best and Friedrich LLP

(57) ABSTRACT

A lighting fixture includes a housing, light source, reflector, tandem lens array, shutter blade, and condenser. The housing includes an outlet. An optical axis extends centrally through the outlet. The light source includes an array of light-emitting diodes. The reflector has an input end positioned along the optical axis between the light source and the outlet. The reflector has an output end positioned along the optical axis between the input end and the outlet. The light source emits light from the input end through the output end. The tandem lens array is positioned along the optical axis between the output end and the outlet. The shutter blade is positioned along the optical axis between the tandem lens array and the outlet. The shutter blade is disposed at least partially within the housing. The condenser, including a lens, is positioned along the optical axis between the shutter blade and the outlet.

20 Claims, 11 Drawing Sheets

(51) Int. Cl.
*F21Y 115/10* (2016.01)
*F21Y 105/18* (2016.01)

(56) References Cited

U.S. PATENT DOCUMENTS

| | | | |
|---|---|---|---|
| 6,222,623 | B1 | 4/2001 | Wetherell |
| 6,382,803 | B1 | 5/2002 | Arumugasaamy |
| 6,527,411 | B1 | 3/2003 | Sayers |
| 6,536,914 | B2 | 3/2003 | Hoelen et al. |
| 6,547,416 | B2 | 4/2003 | Pashley et al. |
| 6,834,982 | B2 | 12/2004 | Dedoro |
| 7,163,317 | B2 | 1/2007 | Warnecke et al. |
| 7,614,767 | B2 | 11/2009 | Zulim et al. |
| 7,777,955 | B2 | 8/2010 | Cassarly et al. |
| 7,874,487 | B2 | 1/2011 | Nunnink et al. |
| 7,946,729 | B2 | 5/2011 | Ivey et al. |
| 8,292,463 | B2 | 10/2012 | Speier et al. |
| 8,456,107 | B2 | 6/2013 | Saem |
| 8,529,103 | B2 | 9/2013 | Tukker et al. |
| 8,602,601 | B2 | 12/2013 | Khazi et al. |
| 8,733,949 | B2 | 5/2014 | Chong et al. |
| 8,814,376 | B2 | 12/2014 | Nicolai et al. |
| 8,915,612 | B2 | 12/2014 | Kurt et al. |
| 9,169,997 | B2 | 10/2015 | Kurt et al. |
| 9,249,947 | B2 | 2/2016 | Goldstein et al. |
| 9,746,596 | B2 | 8/2017 | Preston et al. |
| 9,989,217 | B2 | 6/2018 | Junk et al. |
| 9,995,872 | B2 | 6/2018 | Angelini et al. |
| 10,018,329 | B1 | 7/2018 | Belliveau |
| 10,031,405 | B2 * | 7/2018 | Matsubara ..... F21K 9/64 |
| 10,317,044 | B2 * | 6/2019 | Di Trapani ..... F21S 8/06 |
| 2008/0266893 | A1 | 10/2008 | Speier |
| 2008/0310152 | A1 | 12/2008 | Verbrugh et al. |
| 2010/0113101 | A1 | 10/2010 | Adams |
| 2010/0284201 | A1 | 11/2010 | Alasaanela |
| 2011/0013389 | A1 | 1/2011 | Willemsen et al. |
| 2012/0140463 | A1 | 6/2012 | Kinzer et al. |
| 2013/0329429 | A1 | 12/2013 | Lowes et al. |
| 2014/0117877 | A1 | 5/2014 | Mapel et al. |
| 2015/0362654 | A1 | 12/2015 | Sadasivan et al. |
| 2016/0018064 | A1 | 1/2016 | Jurik et al. |
| 2016/0208999 | A1 | 7/2016 | Junk |
| 2016/0370529 | A1 | 12/2016 | Angelini et al. |
| 2018/0180268 | A1 | 6/2018 | Jurik et al. |

OTHER PUBLICATIONS

Intematix, "Mixing Chamber Design Considerations for ChromaLit™ Remote Phosphor Light Sources", Website: http://www.intematix.com/uploads/application%20notes/MixingChamberDesign.pdf, Application Literature dated Dec. 14, 2017 (11 Pages).

* cited by examiner

LIGHTING FIXTURE WITH INTERNAL SHUTTER BLADE

BACKGROUND

The present disclosure relates to lighting fixtures and, more particularly, to lighting fixtures that utilize light-emitting diodes (LEDs).

SUMMARY

In one aspect, the disclosure relates to a lighting fixture including a housing, a light source, a reflector, a tandem lens array, a shutter blade, and a condenser. The housing includes an outlet through which light passes. An optical axis of the lighting fixture extends centrally through the outlet of the housing. The light source includes an array of light-emitting diodes disposed within the housing. The reflector has an input end positioned along the optical axis between the light source and the outlet of the housing. The reflector also has an output end positioned along the optical axis between the input end and the outlet of the housing. The light source emits light through the reflector from the input end through the output end. The tandem lens array is positioned along the optical axis between the output end of the reflector and the outlet of the housing. The shutter blade is positioned along the optical axis between the tandem lens array and the outlet of the housing. The shutter blade is disposed at least partially within the housing. The condenser is positioned along the optical axis between the shutter blade and the outlet of the housing. The condenser includes a lens. In some embodiments, the lens includes an aspheric lens.

In another aspect, the disclosure relates to a lighting fixture including a housing, a light source, a tapered reflector, a tandem lens array, a shutter blade, and a condenser. The light source includes an array of light-emitting diodes disposed within the housing. The tapered reflector is disposed within the housing and includes an input end and an output end. The input end is adjacent the light source. The output end is opposite the input end. The output end is wider than the input end. The light source emits light through the tapered reflector from the input end through the output end. The tandem lens array is adjacent the output end of the reflector. The tandem lens array is disposed within the housing and includes a first side and a second side. The first side is facing toward the light source and includes an array of lenses. The second side is opposite the first side and includes an array of lenses. The shutter blade is adjacent the second side of the tandem lens array. The shutter blade is disposed at least partially within the housing. The condenser is adjacent the shutter blade. The condenser includes two condenser lenses disposed within the housing.

Other aspects of the disclosure will become apparent by consideration of the detailed description and accompanying drawings.

DETAILED DESCRIPTION

Before any embodiments are explained in detail, it is to be understood that the embodiments are not limited in application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Figure 1:
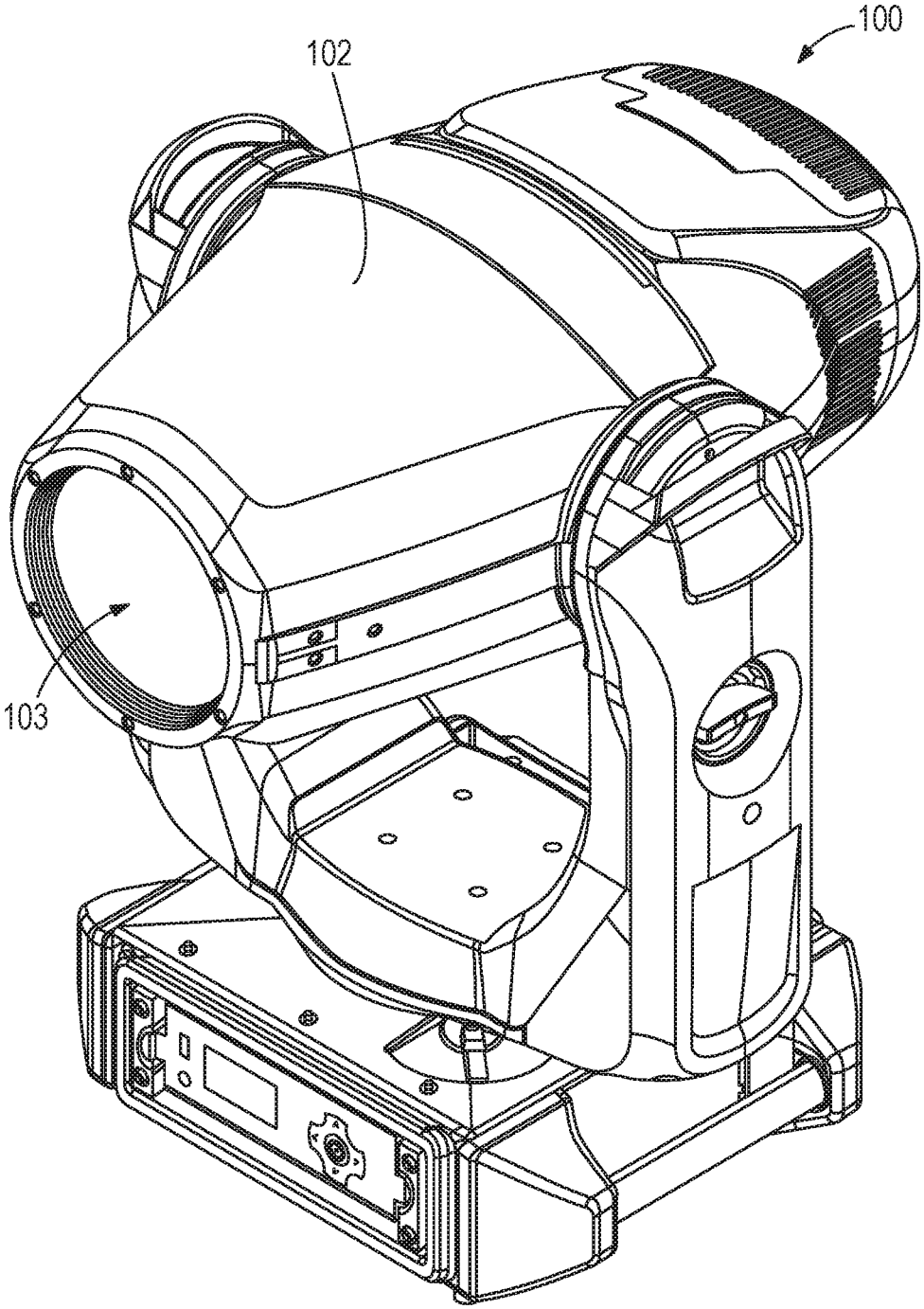
FIG. 1 illustrates a perspective view of a lighting fixture, according to embodiments described herein.
Figure 2:
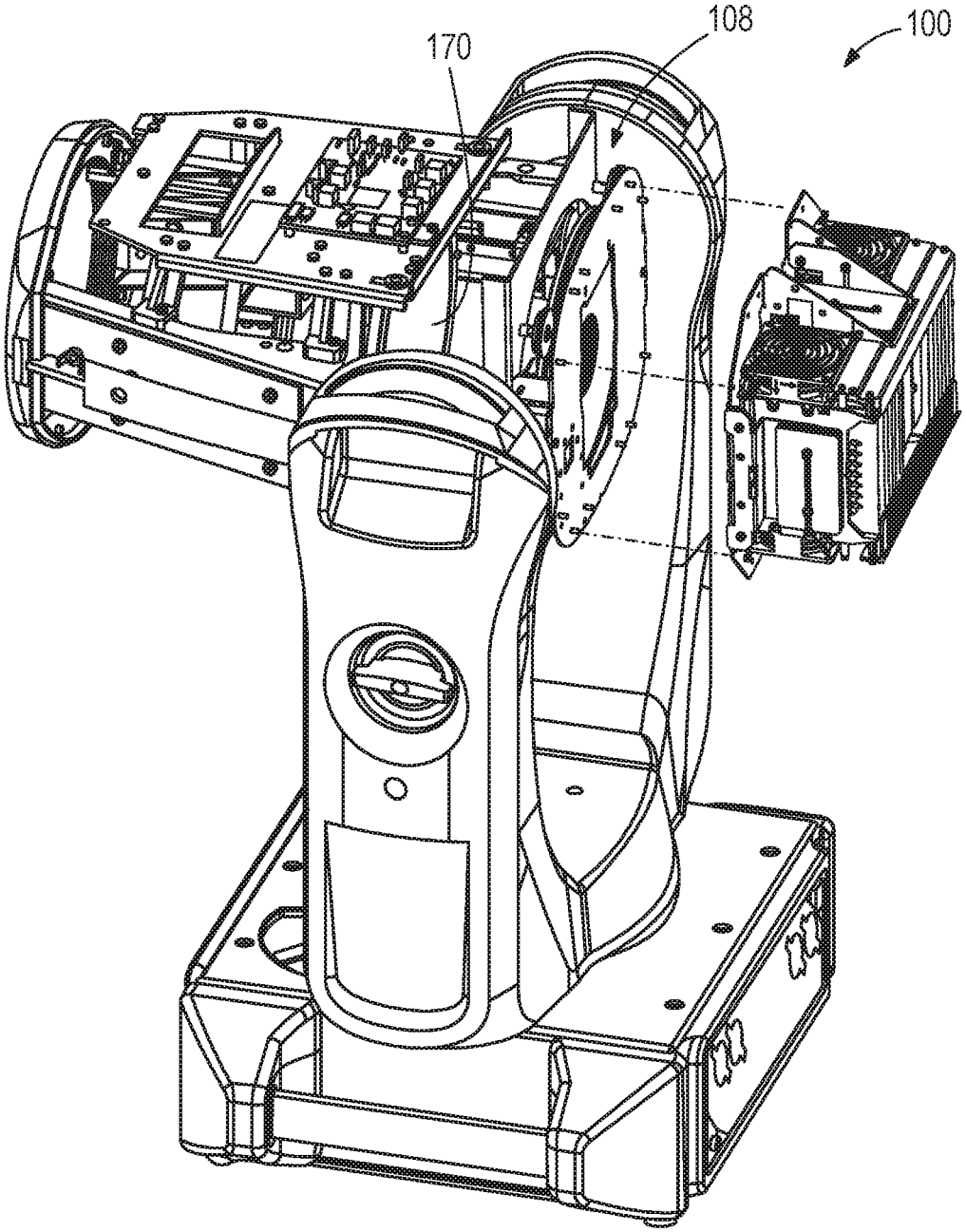
FIG. 2 illustrates a partially exploded view of the lighting fixture of FIG. 1.

FIG. 1 illustrates a lighting fixture, or luminaire 100, having a housing 102 with an outlet 103 defined therein. The outlet 103 allows light to pass therethrough to exit the light fixture 100. As shown in FIG. 2, which illustrates the lighting fixture 100 with the housing 102 removed, various components are contained partially or completely within the housing 102.

Referring to FIGS. 3-6, the lighting fixture 100 includes a light source 104, a light pipe, or reflector, 106, a shutter system 108, and a condenser 110, which are disposed within the housing 102. The lighting fixture 100 is particularly suited for use during live performances including theater productions, concerts, television or movie studio productions, or the like.

Figure 7:
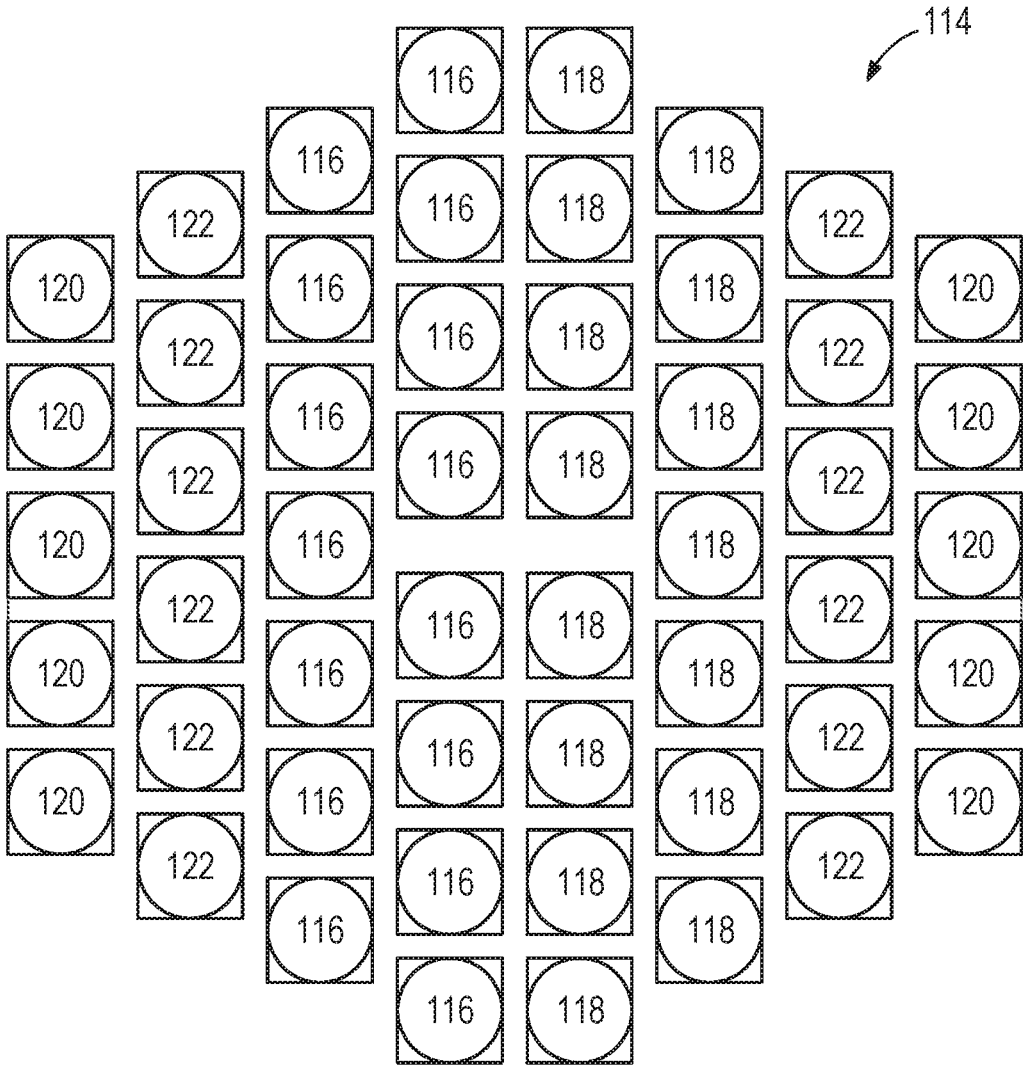
FIG. 7 illustrates an LED color arrangement of an LED array of the lighting fixture of FIG. 1.

With reference to FIG. 7, the light source 104 includes an array 114 of light-emitting diodes (LEDs). In the illustrated embodiment, the array 114 of LEDs is in the shape of a hexagon, which generally matches or corresponds to the cross-sectional shape of an input end 124 of the reflector 106. In other embodiments, a reflector 106 having another cross-sectional shape may be used. In such embodiments, the array 114 of LEDs can match or correspond to the cross-sectional shape of the reflector 106. The illustrated array 114 includes fifty two individual LEDs spaced closely together. The LEDs may be, for instance, Luxeon C LEDs that cooperate to produce about 10,000 lumens. The array 114 can include various colors of LEDs including, for instance, red 116, lime 118, green 120, and indigo 122 color LEDs. In many lighting fixtures, the LEDs must be carefully arranged in order to promote adequate mixing of the light produced from the LEDs. For instance, the LEDs are often arranged symmetrically. In some embodiments, the lighting fixture 100 includes the array 114 including at least two different color LEDs, and the arrangement of the LEDs is asymmetrical with regard to color. The different color LEDs may be radially asymmetrical, bilaterally asymmetrical, or the like. Stated another way, the pattern of LEDs according to color may be different about the optical axis 127 passing through the center of the light source 104. In some embodiments, the pattern of LEDs according to color may be different on one side of the optical axis 127 from on the opposite side of the optical axis 127. In still other embodiments, the LEDs may be scattered according to color such that no pattern exists. In the illustrated embodiment, the array 114 includes straight strips of each of red 116, lime 118, green 120, and indigo 122 color LEDs.

Figure 3:
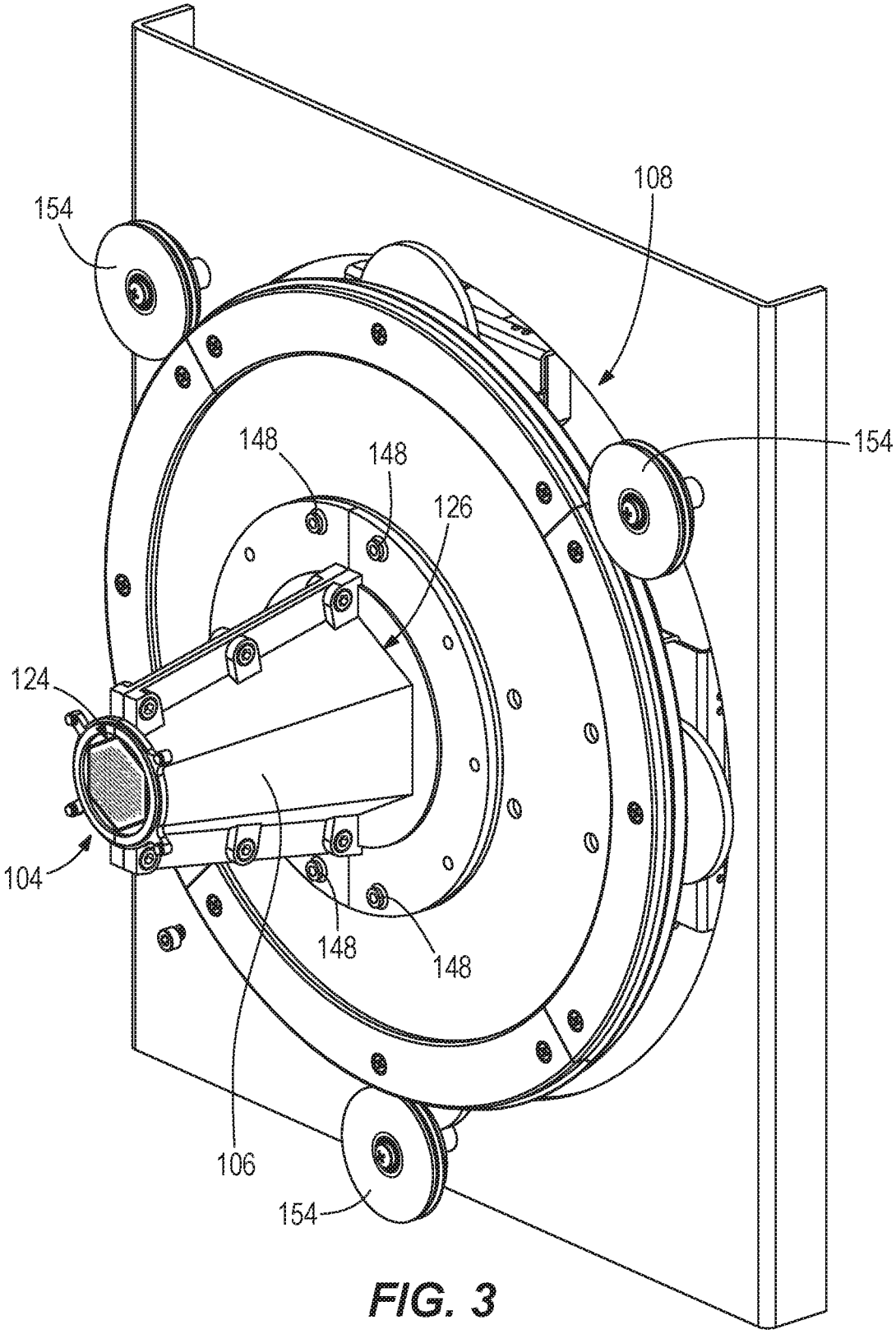
FIG. 3 illustrates a rear perspective view of a light source, a reflector, and a shutter system of the lighting fixture of FIG. 1.
Figure 6:
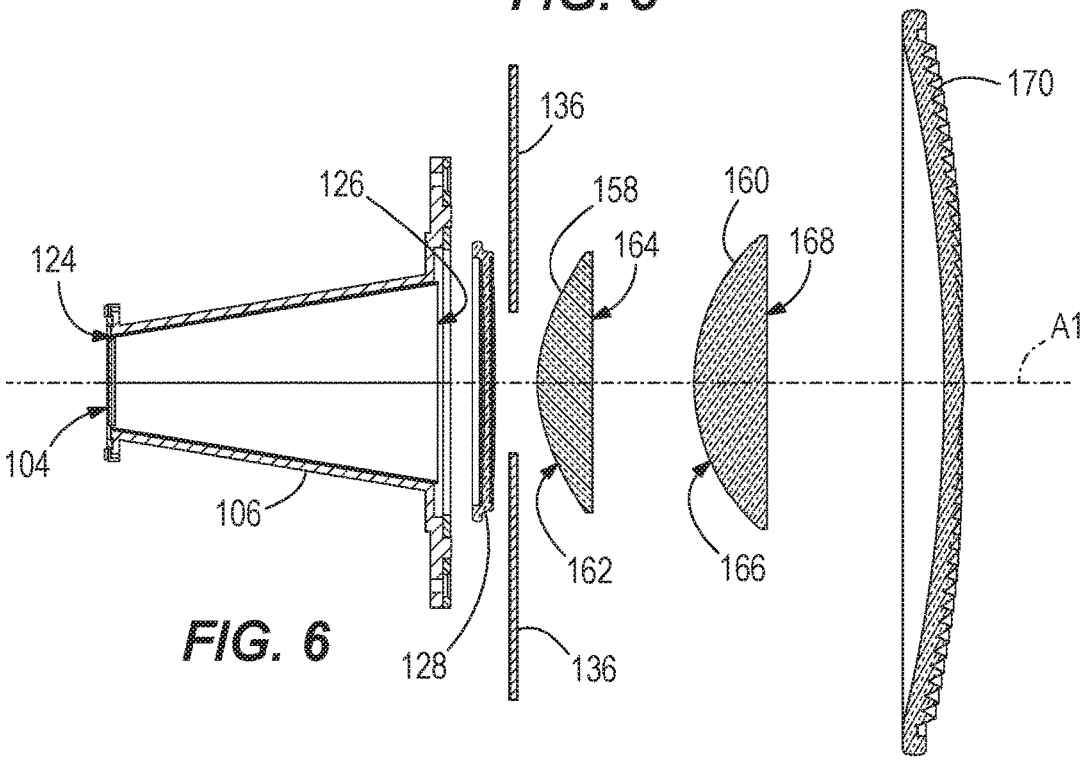
FIG. 6 schematically illustrates a cross-sectional elevation view of the light pathway of the lighting fixture of FIG. 1.
Figure 8:
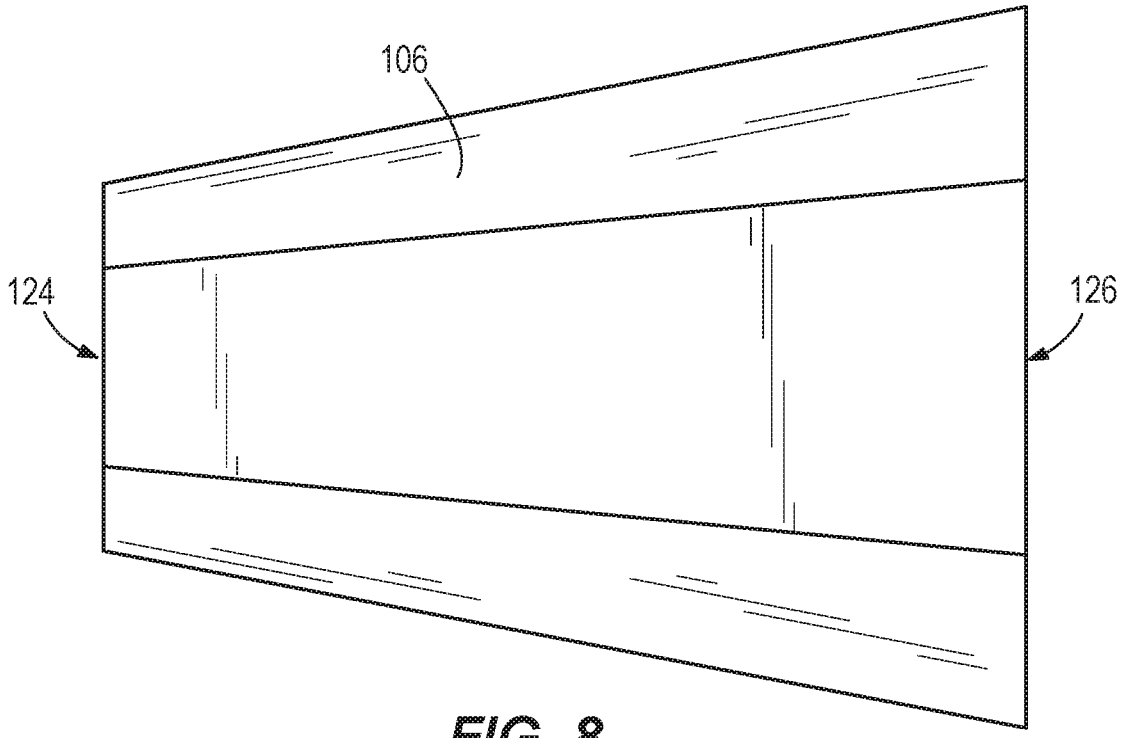
FIG. 8 illustrates a side elevation view reflector of the lighting fixture of FIG. 1.
Figure 9:
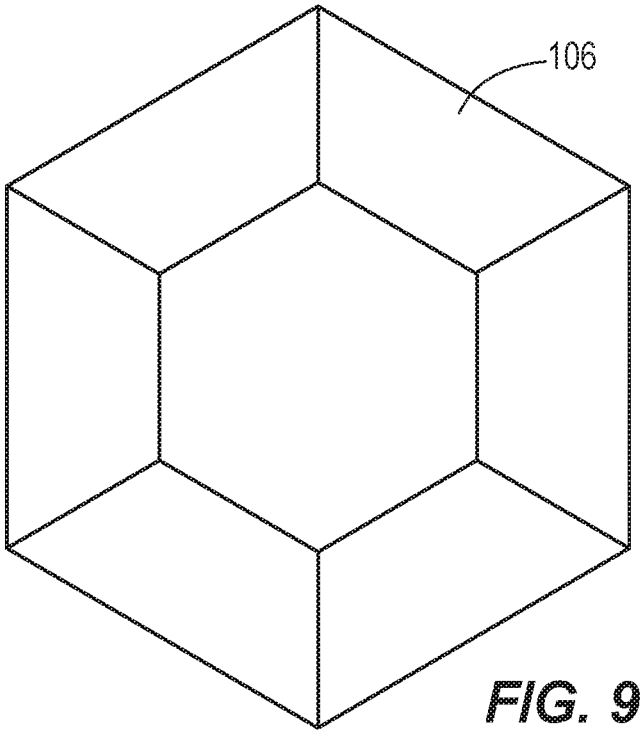
FIG. 9 illustrates a front elevation view of the reflector of FIG. 8
Figure 10:
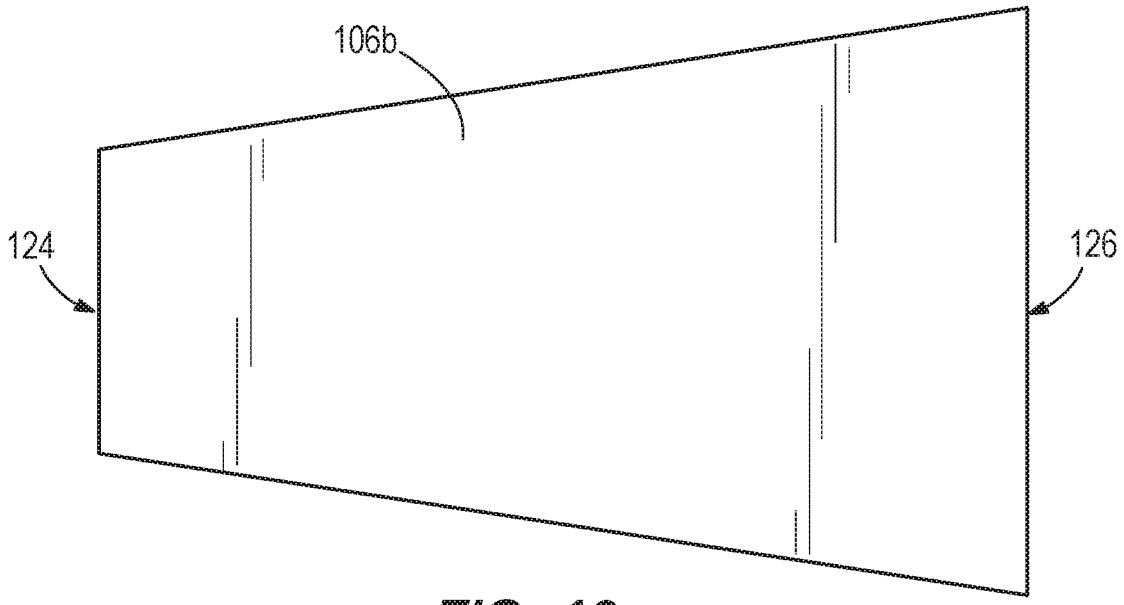
FIG. 10 illustrates a side elevation view of a reflector according to another embodiment described herein.
Figure 11:
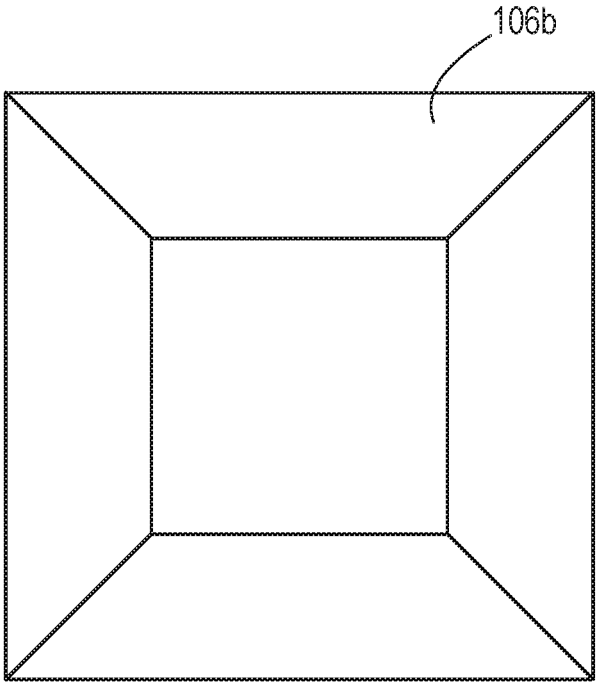
FIG. 11 illustrates a front elevation view of the reflector of FIG. 10.

As shown in FIG. 3, the reflector 106 includes a first end, or input end 124, adjacent the light source 104 and a second end, or output end 126, opposite the input end 124. As is best shown in FIG. 6, the reflector 106 is tapered such that the reflector 106 is narrower at the input end 124 than at the output end 126. Stated another way, the reflector 106 includes an output end 126 that is wider than the input end 124. At the input end 124 of the reflector 106, the width is about the same as a corresponding width of the array 114 of LEDs to reduce or eliminate any gaps between the array 114 and the sidewall(s) of the reflector 106. The light source 104 emits light through the reflector 106 from the input end 124 through the output end 126 in a direction along an optical axis 127 of the lighting fixture 100. As shown in FIGS. 8 and 9, the reflector 106 has a hexagonal cross-sectional shape formed by six side walls. Other embodiments of the lighting fixture 100 may include a reflector 106 of a different shape, such as a reflector 106*b* having a rectangular cross-sectional shape (shown in FIGS. 10 and 11), or the like.

Figure 12:
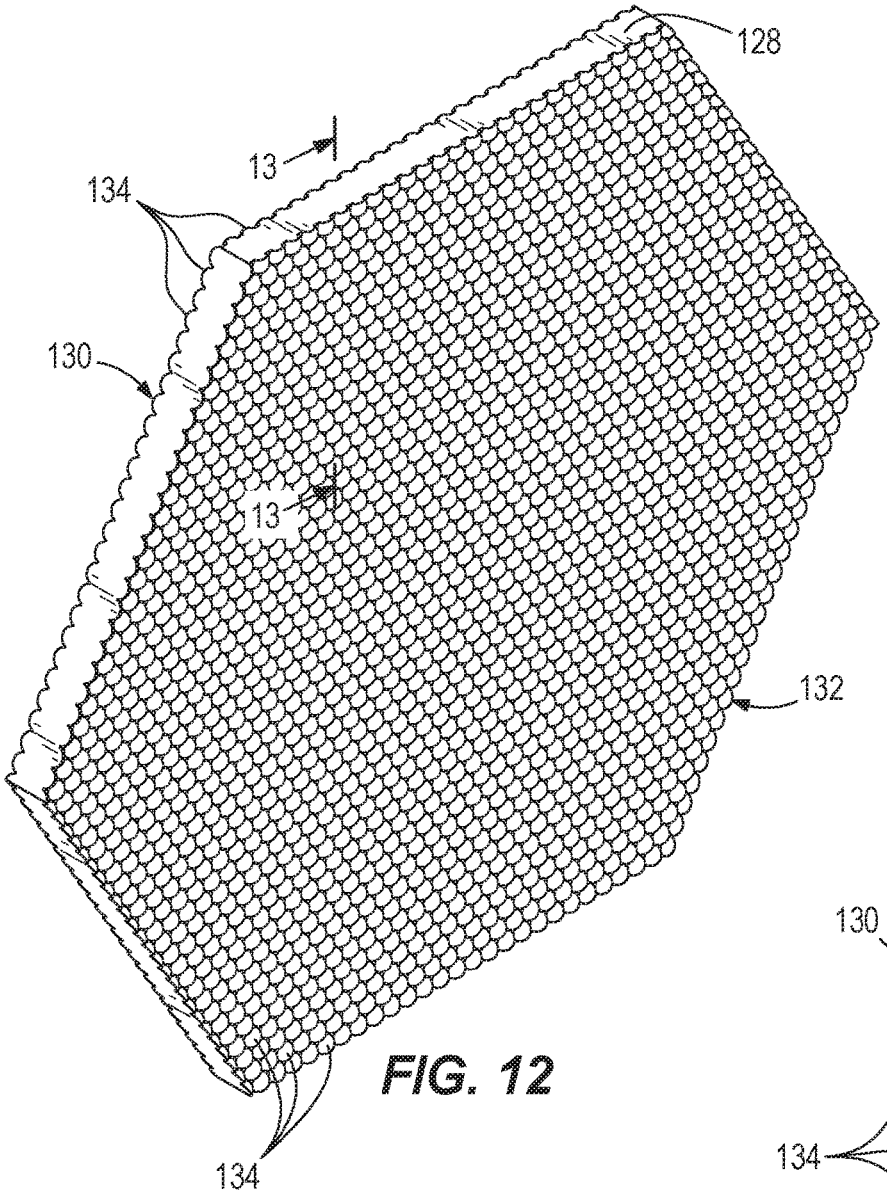
FIG. 12 illustrates a perspective view of a tandem lens array of the lighting fixture of FIG. 1.

As shown in FIG. 6, the lighting fixture 100 further includes a tandem lens array 128 adjacent the output end 126 of the reflector 106. In some embodiments, the tandem lens array 128 is positioned within the output end 126 of the reflector 106. The tandem lens array 128 is also disposed within the housing 102 of the lighting fixture 100. With particular reference to FIG. 12, the tandem lens array 128 is shown as a hexagonal tandem lens array to generally match or correspond to the cross-sectional shape of the output end 126 of the hexagonal reflector 106. In other embodiments, a reflector 106 having another cross-sectional shape may be used. In such embodiments, the tandem lens array 128 can match or correspond to the cross-sectional shape of the reflector 106. Generally, all or substantially all of the light emitted from the reflector 106 passes through the tandem lens array 128. The tandem lens array 128 enhances color mixing and is particularly suited for use in a wash beam type lighting fixture 100.

Figure 13:
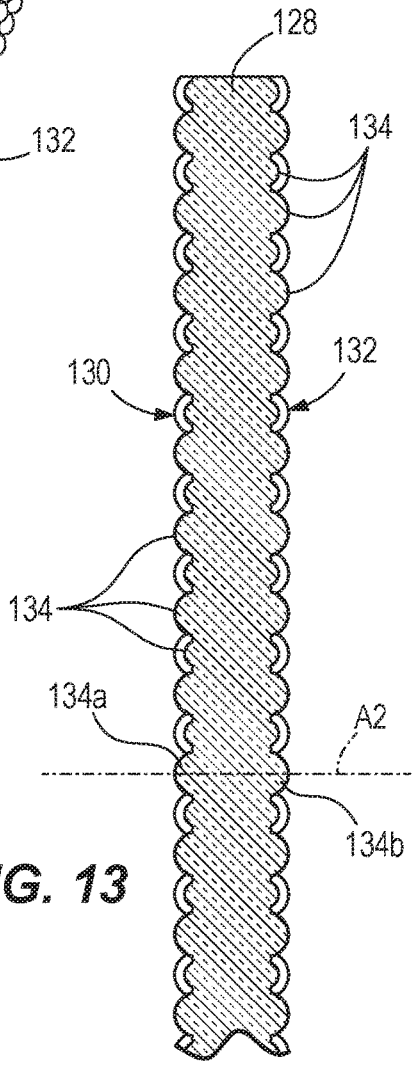
FIG. 13 illustrates a cross-sectional elevation view of the tandem lens array of FIG. 12.

As shown in FIGS. 12 and 13, in some embodiments, the tandem lens array 128 is a single substrate that includes a first side 130 that faces toward the light source 104 and a second side 132 that is opposite the first side 130. Each of the first side 130 and the second side 132 includes an array of approximately semi-sphere shaped lenses 134. The lenses 134 are approximately semi-sphere shaped because the lenses 134 have an F-number that is about 1.159 in the illustrated embodiment, where an F-number of 1.0 would correspond to lenses that are an exact or precise semi-sphere shape. In other embodiments, the pattern of lenses 134 may be randomized rather than repeating. The tandem lens array 128 breaks up the light after it has been mixed and collimated in the reflector 106 into multiple overlapping beams, or Kohler illuminators, which further mixes the light to a better uniformity. In the illustrated embodiment, each lens 134 on the first side 130 is paired with a corresponding lenses 134 on the second side 132 with a common axis 135 that extends centrally through the paired lenses 134. A lens pair 134*a* and 134*b* from the first and second sides 130, 132, respectively, are labeled in FIG. 13 having the common axis 135. In other embodiments, the tandem lens array 128 includes lenses 134 arranged in a circular pattern around a center of the tandem lens array 128. In some embodiments, the tandem lens array 128 includes lenses 134 that have a randomly shaped arrangement.

Figure 14:
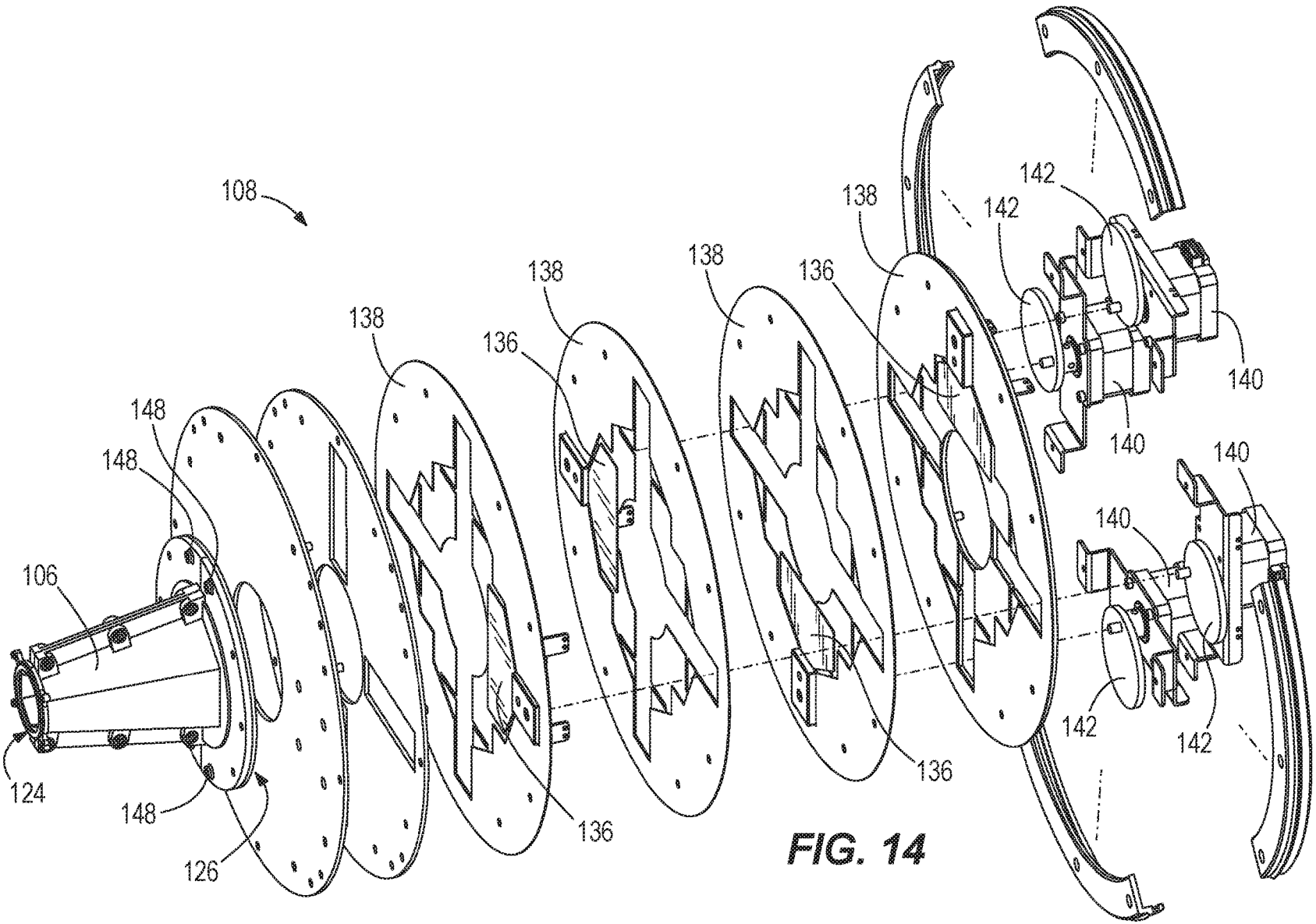
FIG. 14 illustrates a rear perspective view of the reflector and an exploded shutter system of the lighting fixture of FIG. 1.

As shown in FIG. 3, the lighting fixture 100 further includes a shutter system 108. An exploded view of the shutter system 108 is shown in FIG. 14. The shutter system 108 includes a plurality of shutter blades 136. In the illustrated embodiment, each of the shutter blades 136 is disposed entirely within the housing 102 and between the tandem lens array 128 and the outlet 103 of the housing 102. In some embodiments, only a portion of each of the shutter blades 136 may be within the housing 102 with at least a portion of the shutter blades 136 extending through the housing 102 and being disposed outside of the housing 102. In the illustrated embodiment, the shutter blades 136 are disposed adjacent the tandem lens array 128. The illustrated shutter system 108 includes four shutter guide plates 138. Each shutter guide plate 138 includes at least one shutter blade 136. The at least one shutter blade 136 of each guide plate 138 translates relative to the shutter guide plate 138. Each shutter blade 136 is radially adjustable in a direction that is perpendicular to the optical axis 127. In the illustrated embodiment, each shutter blade 136 slides relative to the corresponding shutter guide plate 138.

Figure 15:
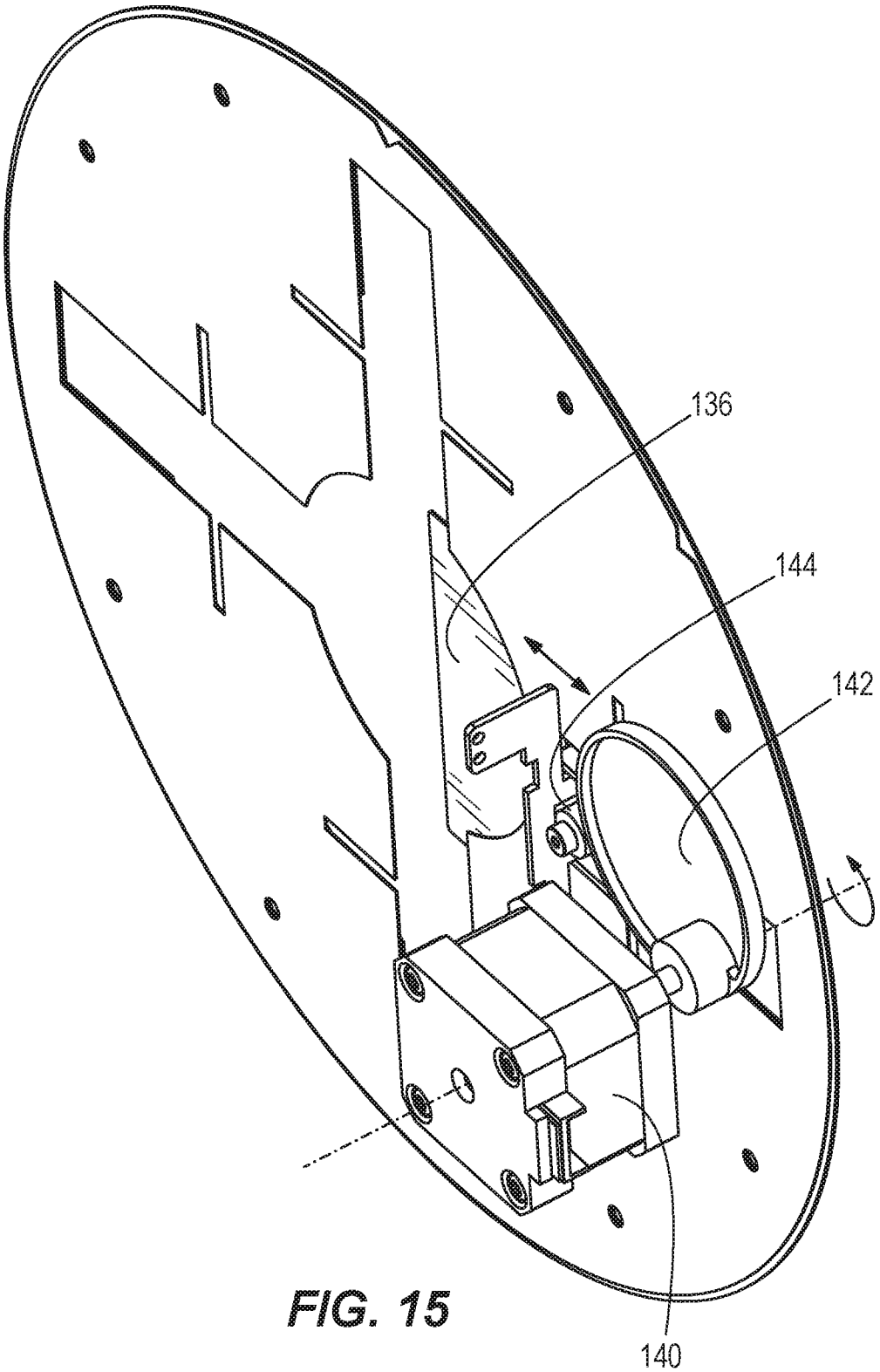
FIG. 15 illustrates a front perspective view of a portion of the shutter system of FIG. 14.

As shown in FIG. 15, the lighting fixture 100 includes a motor 140 associated with each of the shutter guide plates 138 and the corresponding shutter blade 136. Each motor 140 rotates a corresponding cam 142 to engage a follower 144 coupled to the corresponding shutter blade 136. Rotation of the cam 142 pushes the follower 144 such that the shutter blade 136 moves radially toward the optical axis 127. As the cam 142 rotates further, or rotates in the opposite direction, the shutter blade 136 moves away from the optical axis 127 by, for instance, a bias. Stated another way, a spring or other resilient member urges the shutter blade 136 radially outward relative to the optical axis 127.

Figure 4:
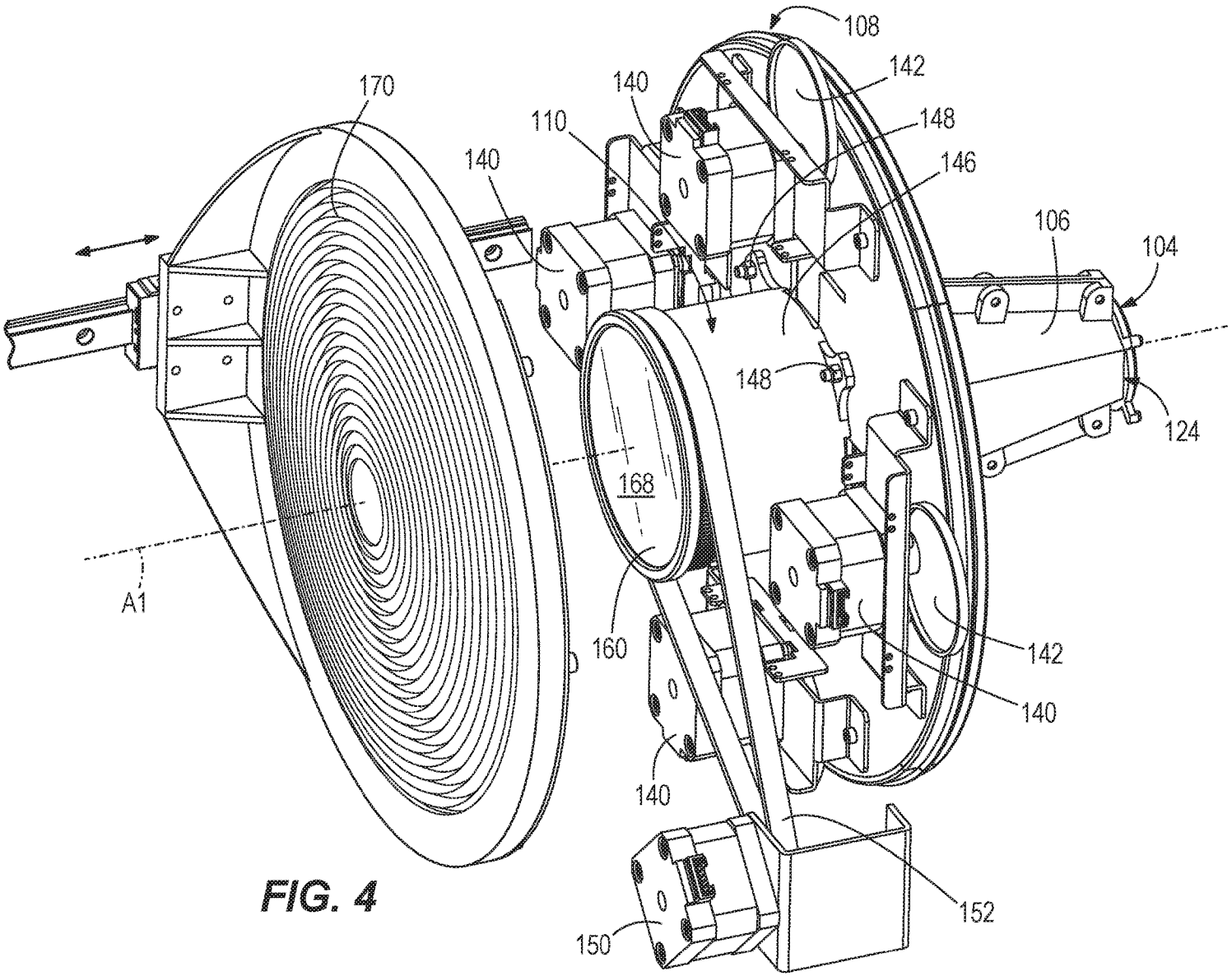
FIG. 4 illustrates a front perspective view of the light source, the reflector, the shutter system, the condenser, and a Fresnel lens of the lighting fixture of FIG. 1.

As shown in FIGS. 3 and 4, the shutter system 108 is rigidly connected to the reflector 106 and a cylindrical frame member 146 with fasteners 148. Shown particularly in FIG. 4, a shutter system rotation motor 150 rotates a belt 152, which, in turn, rotates the cylindrical frame member 146. Due to the rigid connections, operation of the shutter system rotation motor 150 causes the shutter guide plates 138 and the corresponding shutter blades 136 to rotate about the optical axis 127. This rotation allows the shutter blades 136 to move to different positions about the optical axis 127 to alter the shape of the light permitted to travel along the optical axis 127. Shown particularly in FIG. 3, the shutter system 108 is supported by multiple rollers 154, which maintain the components of the lighting fixture 100 in place laterally as the components rotate about the optical axis 127.

With reference to FIG. 4, the lighting fixture 100 further includes the condenser 110 disposed along the optical axis 127 between the shutter system 108 and the outlet 103 of the housing 102. In the illustrated embodiment shown in FIGS. 5 and 6, the condenser 110 includes a first condenser lens 158 and a second condenser lens 160. At least one of the first condenser lens 158 and the second condenser lens 160 may be an aspheric lens. In the illustrated embodiment, the first condenser lens 158 is an aspheric lens and the second condenser lens 160 is a spherical lens. The first condenser lens 158 is disposed nearer to the shutter system 108 than the second condenser lens 160. The second condenser lens 160 is positioned along the optical axis 127 between the first condenser lens 158 and the outlet 103 of the housing 102. In the illustrated embodiment, the first condenser lens 158 includes a first curved side 162 that faces toward the light source 104 and a first flat side 164 that is opposite the first curved side 162. The second condenser lens 160 includes a second curved side 166 that faces toward the light source 104 and a second flat side 168 that is opposite the second curved side 166. Both the first condenser lens 158 and the second condenser lens 160 are coupled to the cylindrical frame member 146 such that the first condenser lens 158 and the second condenser lens 160 are axially fixed relative to the tandem lens array 128 and will rotate with the shutter system 108.

Figure 5:
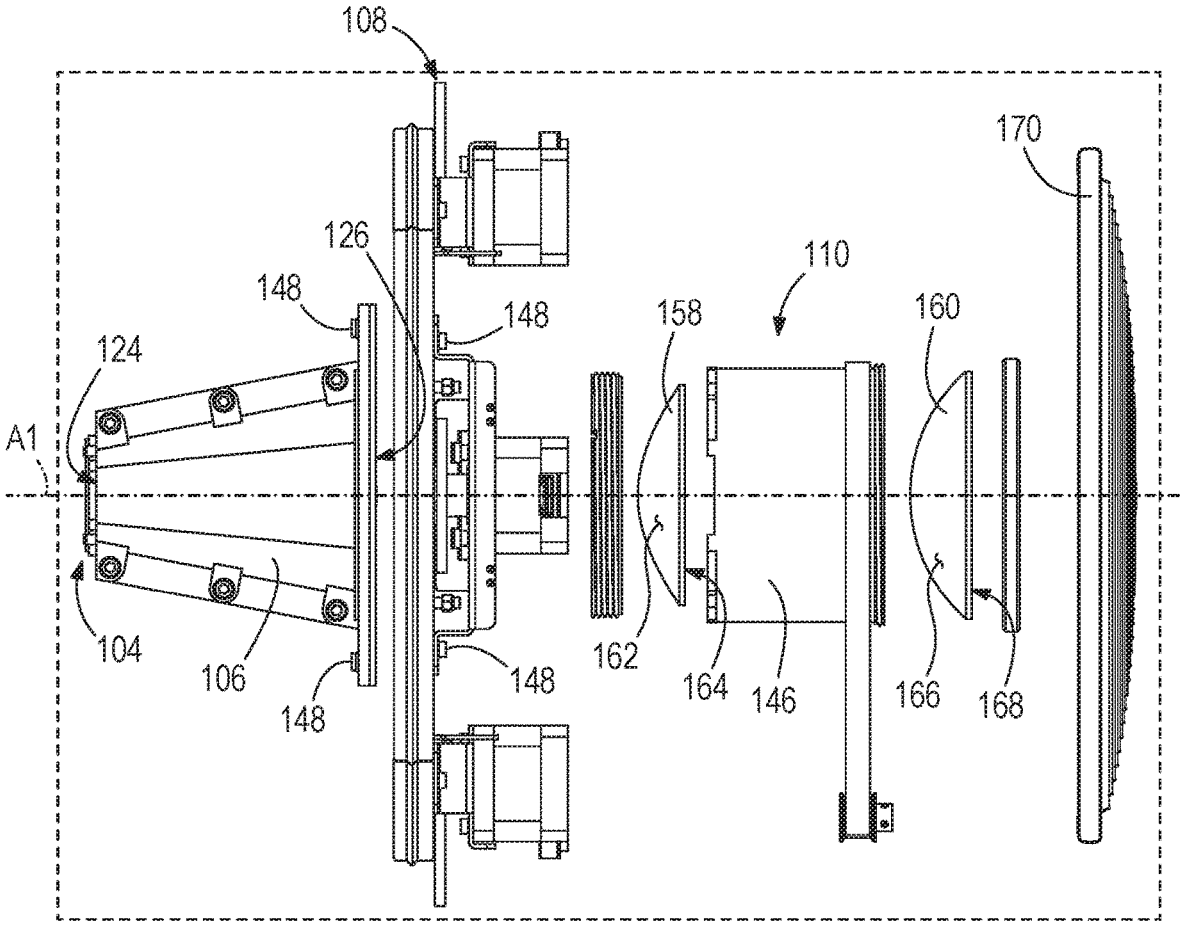
FIG. 5 illustrates a side elevation view of an exploded portion of the lighting fixture of FIG. 1.

As shown in FIGS. 4-6, the lighting fixture 100 also includes a Fresnel lens 170. The Fresnel lens 170 is disposed along the optical axis 127 between the condenser 110 and the outlet 103 of the housing 102. With reference to FIGS. 5 and 6, the light source 104, the reflector 106, the tandem lens array 128, the shutter system 108, the condenser 110, and the Fresnel lens 170 are all aligned along the optical axis 127, which extends longitudinally through the lighting fixture 100. The Fresnel lens 170 is movable along the optical axis 127 to alter the beam angle of the light traveling through and exiting the lighting fixture 100. Because the light source 104, the reflector 106, the tandem lens array 128, the shutter system 108, and the condenser 110 are all axially stationary relative to each other along the optical axis 127, the Fresnel lens 170 moves axially relative to these components of the lighting fixture 100.

In the illustrated embodiment, the light source 104, the reflector 106, the tandem lens array 128, the shutter system 108, the condenser 110, and the Fresnel lens 170 are all wholly disposed within the housing 102 of the lighting fixture 100.

Thus, embodiments described herein provide a lighting fixture having a shutter blade at least partially disposed within the housing of the lighting fixture.

What is claimed is:

1. A lighting fixture comprising:

a housing including an outlet through which light passes;

an optical axis extending centrally through the outlet;

a light source including an array of light-emitting diodes (LEDs) disposed within the housing;

a reflector including an input end positioned along the optical axis between the light source and the outlet of the housing, and an output end positioned along the optical axis between the input end and the outlet of the housing, such that the light source emits light through the reflector from the input end through the output end;

a tandem lens array positioned along the optical axis between the output end of the reflector and the outlet of the housing;

a shutter blade positioned along the optical axis between the tandem lens array and the outlet of the housing, the shutter blade disposed at least partially within the housing; and a condenser positioned along the optical axis between the shutter blade and the outlet of the housing, the condenser including a lens.

2. The lighting fixture of claim 1, wherein the lens includes an aspheric lens.

3. The lighting fixture of claim 2, wherein the condenser further includes a second lens positioned along the optical axis between the aspheric lens and the outlet of the housing.

4. The lighting fixture of claim 3, wherein the second lens includes a spherical lens.

5. The lighting fixture of claim 3, wherein each of the aspheric lens and the second lens includes a curved side that faces toward the light source and a flat side that is opposite the curved side.

6. The lighting fixture of claim 1, wherein the tandem lens array includes a first side that faces toward the light source and a second side that is opposite the first side, the first side includes an array of lenses, and the second side includes an array of lenses.

7. The lighting fixture of claim 1, wherein the reflector includes a tapered reflector being narrower at the input end than the output end.

8. The lighting fixture of claim 7, wherein the reflector has a hexagonal cross-section.

9. The lighting fixture of claim 1, wherein the shutter blade is adjacent the tandem lens array.

10. The lighting fixture of claim 1, wherein the condenser is in an axially fixed position relative to the tandem lens array.

11. The lighting fixture of claim 1, further comprising a Fresnel lens positioned along the optical axis between the condenser and the outlet of the housing.

12. The lighting fixture of claim 10, wherein the Fresnel lens moves relative to the condenser along the optical axis.

13. The lighting fixture of claim 1, wherein the array of LEDs includes two different color LEDs, and the arrangement of the LEDs is radially asymmetrical with regard to color.

14. The lighting fixture of claim 13, wherein each color of LEDs is arranged in a straight strip of LEDs.

15. A lighting fixture comprising:

a housing;

a light source including an array of light-emitting diodes (LEDs) disposed within the housing;

a tapered reflector disposed within the housing, the tapered reflector including an input end adjacent the light source, an output end opposite the input end, the output end being wider than the input end, and wherein the light source emits light through the tapered reflector from the input end through the output end;

a tandem lens array adjacent the output end of the reflector, the tandem lens array disposed within the housing and including a first side facing toward the light source, the first side including an array of lenses, and a second side opposite the first side, the second side including an array of lenses;

a shutter blade adjacent the second side of the tandem lens array, the shutter blade disposed at least partially within the housing; and a condenser adjacent the shutter blade, the condenser including two condenser lenses disposed within the housing.

16. The lighting fixture of claim 15, wherein the light source, the tapered reflector, the tandem lens array, the shutter blade, and the condenser lenses are all aligned along an optical axis extending longitudinally through the lighting fixture.

17. The lighting fixture of claim 16, further comprising a Fresnel lens disposed adjacent the condenser and aligned along the optical axis, the Fresnel lens adjustable along the optical axis.

18. The lighting fixture of claim 17, wherein the light source, the tapered reflector, the tandem lens array, the shutter blade, and the condenser lenses are stationary relative to each other along the optical axis.

19. The lighting fixture of claim 18, wherein the shutter blade is adjustable in a direction perpendicular to the optical axis.

20. The lighting fixture of claim 15, wherein the shutter blade is disposed completely within the housing.

* * * * *